US008011940B1

(12) United States Patent
Wu

(10) Patent No.: US 8,011,940 B1
(45) Date of Patent: Sep. 6, 2011

(54) POWER SOCKET DEVICE HAVING SWITCHES

(75) Inventor: Jui-hsiung Wu, Taipei (TW)

(73) Assignees: Well Shin Technology Co., Ltd., Taipei (TW); Dongguan Well Shin Electronic Products Co., Ltd., Dongguan, Guangdong Province (CN)

( * ) Notice: Subject to any disclaimer, the term of this patent is extended or adjusted under 35 U.S.C. 154(b) by 0 days.

(21) Appl. No.: 12/961,502

(22) Filed: Dec. 7, 2010

(51) Int. Cl.
*H01R 29/00* (2006.01)

(52) U.S. Cl. ..... 439/188; 200/51.04

(58) Field of Classification Search ..... 439/131, 439/188; 200/51.02–51.04
See application file for complete search history.

(56) References Cited

U.S. PATENT DOCUMENTS 6,750,410 B2 * 6/2004 Lee ..... 200/51.03
7,497,740 B2 * 3/2009 Mei et al. ..... 439/652
7,581,977 B1 * 9/2009 Wu ..... 439/346
2008/0176433 A1 * 7/2008 Sun ..... 439/188
2009/0305537 A1 * 12/2009 Esposito ..... 439/188
2010/0136812 A1 * 6/2010 Wu ..... 439/188

* cited by examiner

*Primary Examiner* — Renee S Luebke
*Assistant Examiner* — Larisa Tsukerman
(74) *Attorney, Agent, or Firm* — Cheng-Ju Chiang

(57) ABSTRACT

A power socket device having switches is disclosed and has a housing, socket units, two conductive frames and switch units. The housing has bolt holes. Each of the socket units has a socket body and a pair of conductive terminals. The socket body is formed with a pair of terminal slots. The socket unit can be received in the housing, and slid upward and downward therein. The conductive terminals are inserted in the terminal slots, and selectively in contact with or disconnected from the conductive frames. The socket body has an engagement hole. The switch unit is inserted into the bolt hole, and selectively abutted against the socket body or engaged in the engagement hole, so that the socket unit can be positioned on a predetermined position on a vertical direction. Thus, it is unnecessary to unplug a plug of an external appliance when switching on or off the power.

6 Claims, 4 Drawing Sheets

POWER SOCKET DEVICE HAVING SWITCHES

FIELD OF THE INVENTION

The present invention relates to a power socket device, and more particularly to a power socket device having switches, so that it is unnecessary to unplug plugs of external appliances from the power socket device after use.

BACKGROUND OF THE INVENTION

Nowadays, power socket devices are widely used in daily life and working, wherein the power socket device can be plugged by a plug of an external appliance to transmit and supply an electric power thereto. Traditional, an external appliance has a plug to be electrically connected to the power socket device. After a user uses the external appliance, the user generally unplugs the plug from the power socket device for saving the power. However, the unplugging operation is inconvenient for most of users, so that it is difficult to completely carry out the unplugging operation every time. Furthermore, when repeating to connect/disconnect the plug with/from the power socket device after long-term use, an abrasion will be easily generated between the plug and the power socket device, so as to affect the lift time of the plug and/or the power socket device. Moreover, when the plug is inserted into the power socket device in a case that the external appliance is turned on, a spark will be generated between the plug and the power socket device due to over-current during the plug is transiently in contact with the power socket device, so that the metal of a contact portion therebetween will be heated, melt and deformed. Even, the lift time of internal components in the external appliance will be lowered. As a result, the traditional plugs must be frequently unplugged, so as to cause the inconvenience and the life time of the external appliance will be easily lowered.

SUMMARY OF THE INVENTION

A primary object of the present invention is to provide a power socket device having switches, wherein it is unnecessary to unplug plugs of external appliances from the power socket device after use, and thus can overcome the disadvantages existing in the conventional technologies, as described above.

To achieve the above object, a power socket device having switches of a preferred embodiment of the present invention comprises: a housing formed with a plurality of recesses on a top portion thereof, and one side wall of the housing being formed with a plurality of bolt holes opened through the recesses, respectively, wherein at least one side wall of each of the recesses is formed with a retaining groove extending vertically, while a lower wall of each of the recesses is formed with an insertion hole opened through the inside of the housing; a plurality of socket units received in the recesses and partially extending into the insertion holes respectively, each of the socket units comprises a socket body and a pair of conductive terminals installed in the socket body, wherein each of the socket bodies is formed with an engagement hole corresponding to one bolt hole and a slide block slidably disposed in the retaining groove, each of the socket units is enabled to move upward and downward by the slide block; a plurality of switch units, each of which is corresponding to one of the socket units, wherein each of the switch units comprises a bolt rod passing through one bolt hole and is enabled to move forward and backward; and a pair of conductive frames engaged in the housing and disposed under the socket units, wherein when the socket unit moves to an upper level in the recess, the bolt rod abuts against the socket body, and the conductive terminals are disconnected from the conductive frames; when the socket unit moves to a lower level in the recess, the bolt rod engages into the engagement hole to position the socket body, and the conductive terminals are in contact with the conductive frames.

In one embodiment of the present invention, each of the switch units further has a bolt handle disposed outside the housing and covering one of the bolt holes, a bolt-returning spring and a socket-returning spring; the bolt-returning spring is sleeved on the bolt rod and disposed between the side wall of the recess and the socket body, the socket-returning spring is sleeved on a lower portion of the socket body and disposed between the recess and the bottom of the housing, the socket-returning spring is compressed when the socket unit moves to the lower level in the recess; the bolt rod has an installation end and an engagement end, the installation end passes through the bolt hole to be installed in the bolt handle, the engagement end selectively abuts against the socket body or engages into the engagement hole of the socket body, wherein the bolt handle is enabled to be resiliently pulled outward to release the engagement end from the engagement hole and decompress the socket-returning spring.

In one embodiment of the present invention, the engagement end is spherically convex, and each of the switch units further has a gasket which is sleeved on the bolt rod and disposed between the bolt-returning spring and the side wall of the recess; and wherein the bolt rod further has an engagement flange close to the engagement end and radially extended therefrom, and the bolt-returning spring abuts against a front side of the engagement flange and is disposed between the side wall of the recess and the socket body.

In one embodiment of the present invention, an upper portion of the socket body is formed with a receiving recess; each of the socket body is formed with two terminal slots therein, each of two lateral sides of the receiving recess is formed with an engagement slots, while each of a front side and a rear side of the lower portion of the socket body is also formed with an engagement slot; each of the socket units further has an upper socket cover mounted on the upper portion of the socket body and a lower socket cover mounted on the lower portion of the socket body; the upper socket cover has a central portion formed with two through slots corresponding to the terminal slots; each of two lateral sides of the upper socket cover is projected to form an engagement block; the upper socket cover is engaged in the receiving recess, and the engagement blocks are engaged with the engagement slots on the two lateral sides of the receiving recess; the lower socket cover has a central portion formed with openings corresponding to the terminal slots; each of a front side and a rear side of the lower socket cover is projected to form an engagement block, and the engagement blocks are engaged with the engagement slots on the front side and the rear side of the lower portion of the socket body.

In one embodiment of the present invention, the housing comprises an upper housing and a lower housing; the recesses, the bolt holes, the retaining grooves and the insertion holes are formed at the upper housing; the lower housing has a lower plate, and a periphery of the lower plate is projected upward to form an enclosing wall, the lower plate is vertically extended upward to form a plurality of partition plates cooperatively forming a plurality of receiving portions; the lower plate is vertically extended to form a plurality of support plates and a plurality of positioning posts; each of the conductive frames has a strip-like conductive portion, wherein each of two face-to-face side edges of the conductive portions is vertically bent and extended to form a plurality of engagement portions, each of which has a distal end horizontally extended to form a contact portion, wherein the contact portion has an upper surface formed with a contact block; the conductive portion is engaged between the partition plates, the engagement portions are engaged into the receiving portions, and the contact portions are supported by the support plates.

In one embodiment of the present invention, the power socket device further comprises a separate plate which is formed with a plurality of apertures corresponding to the socket units, respectively, and a plurality of positioning holes; the separate plate is disposed above the conductive frames, and the positioning holes are aligned with the positioning posts; the contact portions and the contact blocks of the conductive frames correspondingly extend out of the apertures of the separate plate.

As described above, according to the power socket device having switches of the present invention, a lower portion of each of the socket units is installed with one of the socket-returning springs, so that the socket unit can be selectively shifted upward or downward to be electrically connected to or disconnected from the conductive frames. A front side of each of the socket units is installed with one of the switch units, which can be selectively shifted forward or backward to be elastically released or compressed to abut against the socket unit, so that the socket unit can be positioned on a predetermined upper or lower position on a vertical direction. Thus, it is unnecessary to unplug a plug of an external appliance when switching on or off the power. As a result, the operation of the power socket device is relatively simple, while the life time of the external appliance can be elongated.

DETAILED DESCRIPTION OF THE PREFERRED EMBODIMENTS

The structure and the technical means adopted by the present invention to achieve the above and other objects can be best understood by referring to the following detailed description of the preferred embodiments and the accompanying drawings. Furthermore, directional terms described by the present invention, such as upper, lower, front, back, left, right, inner, outer, side and etc., are only directions by referring to the accompanying drawings, and thus the used directional terms are used to describe and understand the present invention, but the present invention is not limited thereto.

Figure 1:
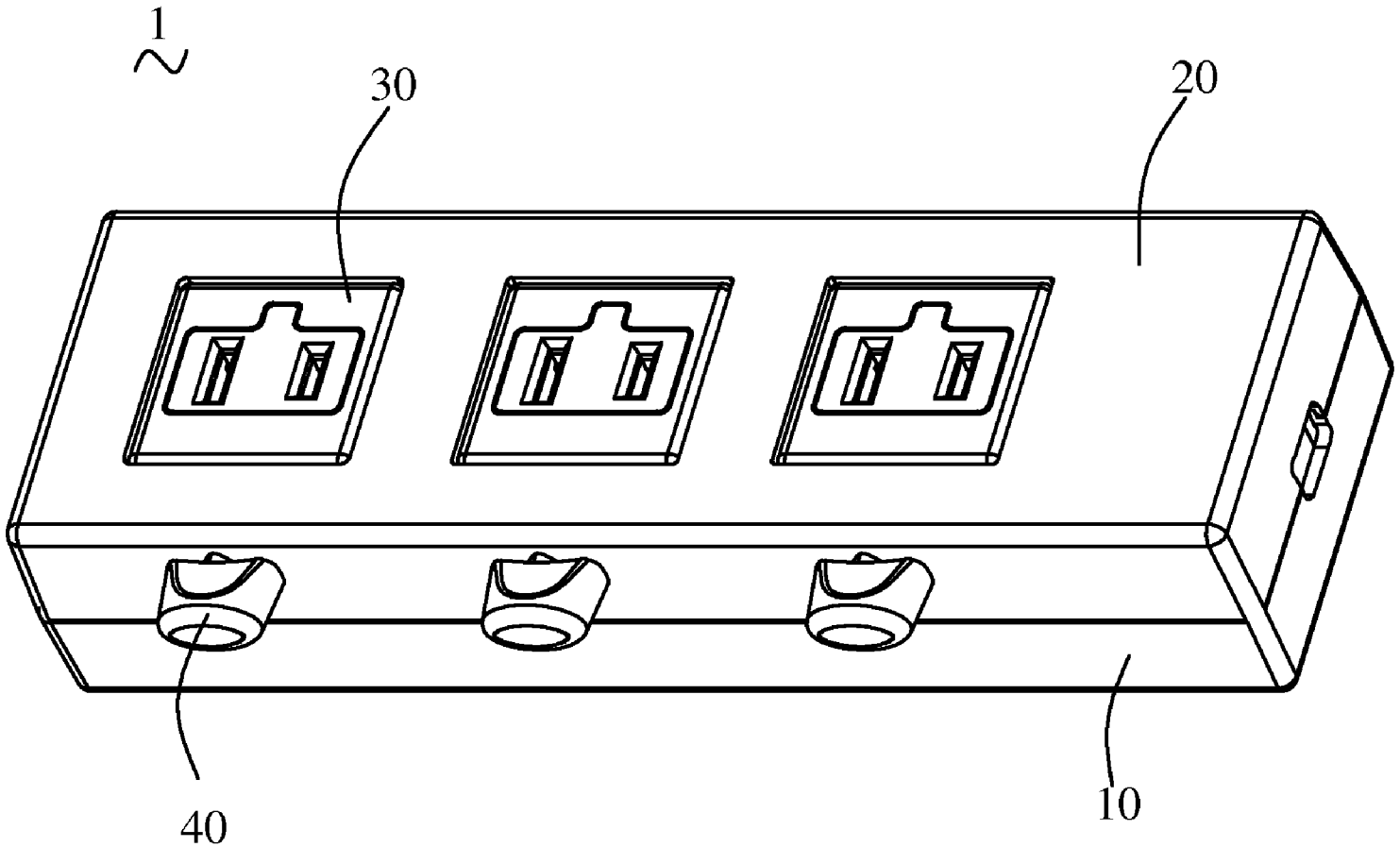
FIG. 1 is an assembled perspective view of a power socket device having switches according to a preferred embodiment of the present invention.
Figure 2:
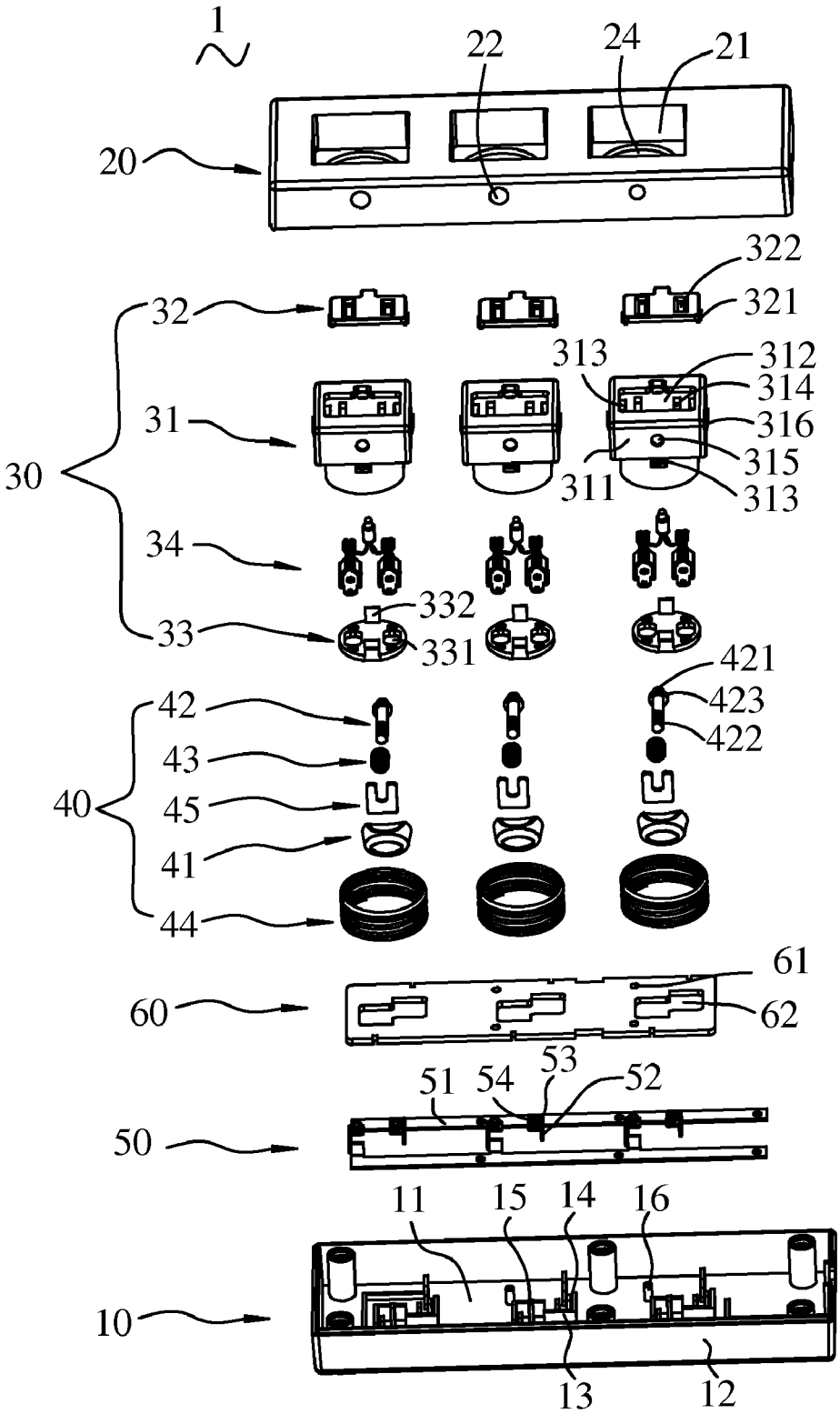
FIG. 2 is an exploded perspective view of the power socket device having switches according to the preferred embodiment of the present invention, as shown in FIG. 1.

Referring now to FIGS. 1 and 2, a power socket device having switches according to a preferred embodiment of the present invention is illustrated. As shown, a power socket device 1 having switches is a dual-hole type socket device having three socket units, wherein the power socket device 1 comprises a housing, a plurality of socket units 30, a plurality of switch units 40, two conductive frame 50 and a separate plate 60, wherein the housing comprises an upper housing 20 and a lower housing 10 covered with each other.

Referring to FIG. 1, the lower housing 10 has a lower plate 11, wherein a periphery of the lower plate 11 is projected upward to form an enclosing wall 12, and the lower plate 11 is vertically extended upward to form a plurality of partition plates 13, each of which encloses to form a plurality of receiving portions 14. The lower plate 11 is vertically extended to form a plurality of support plates 15 and a plurality of positioning posts 16.

Figure 3:
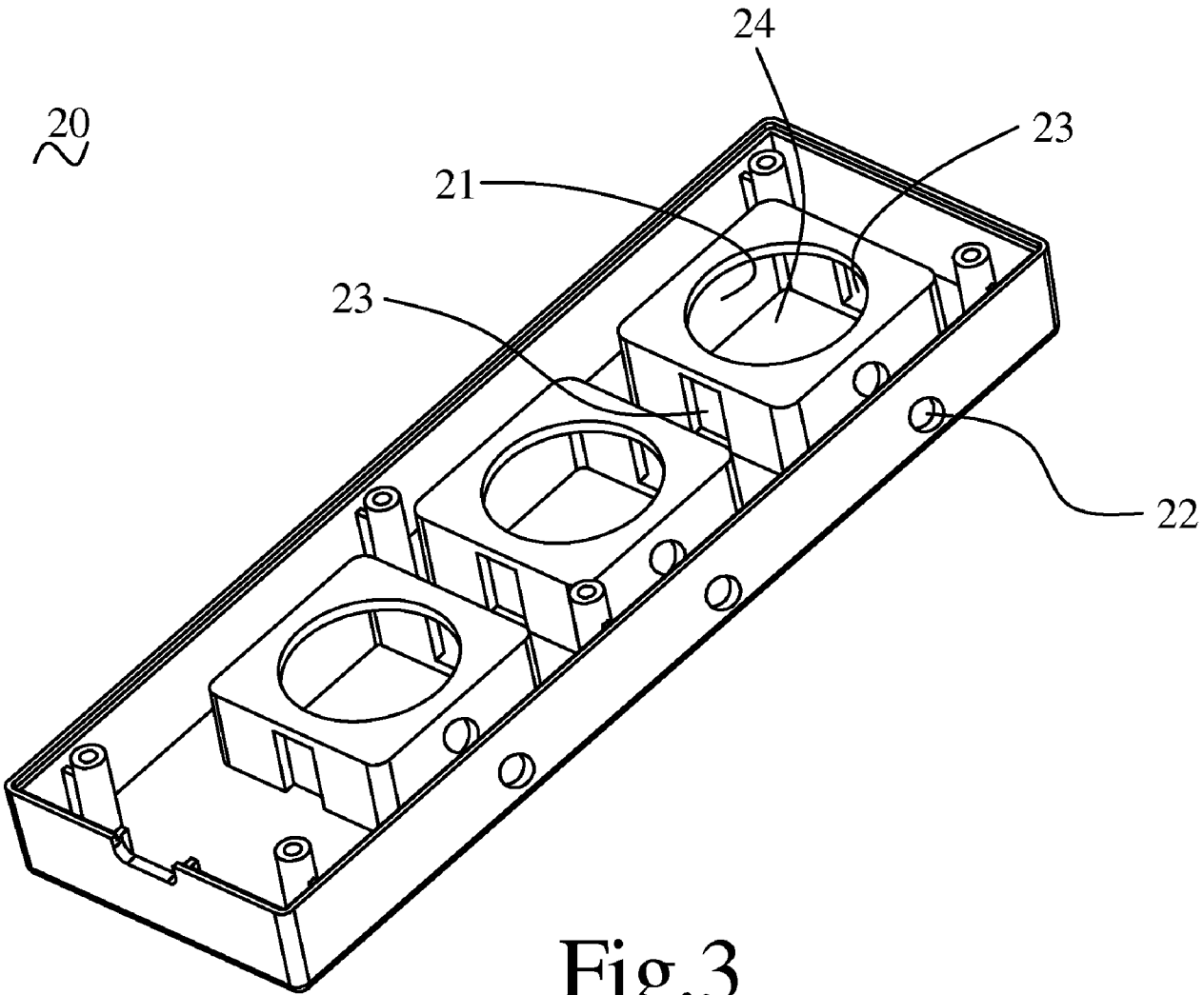
FIG. 3 is a perspective bottom view of an upper housing of the power socket device having switches according to the preferred embodiment of the present invention, as shown in FIG. 1.
Figure 4:
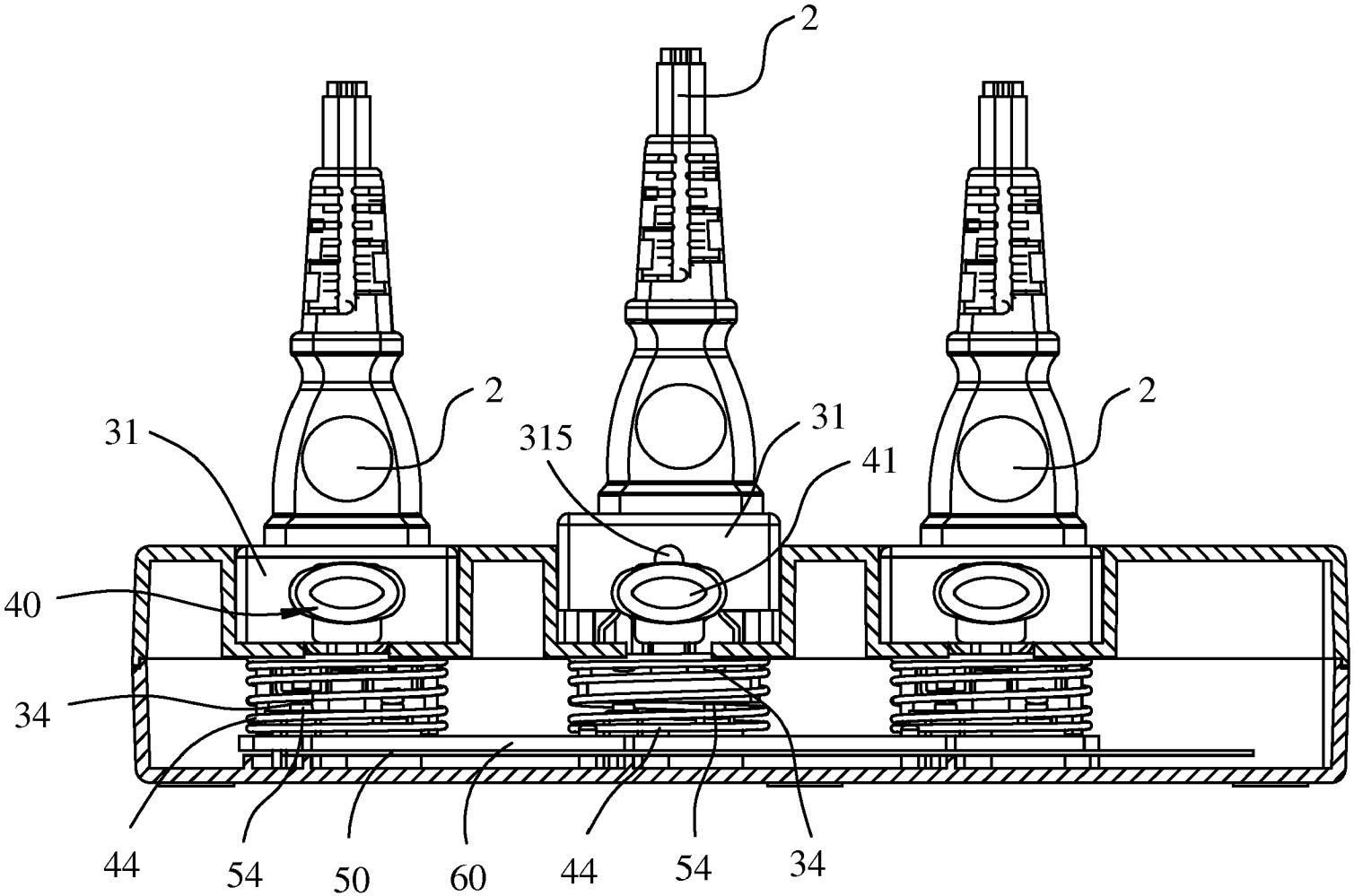
FIG. 4 is a cross-sectional front view of the power socket device having switches according to the preferred embodiment of the present invention after a plug of an external appliance is plugged in the power socket device of FIG. 1, wherein the first and third socket units are electrically connected to the plugs, while the second socket unit is electrically disconnected from the plug.

Referring now to FIGS. 2 to 4, the upper housing 20 can be covered on the lower housing 10, wherein an upper plate of the upper housing 20 is recessed downward to form a plurality of rectangular recesses 21. An enclosing wall of the upper housing 20 (corresponding to the enclosing wall 12 of the lower housing 10) has one side formed with a plurality of bolt holes 22 communicated with an inner space of the recesses 21, wherein each of the recesses 21 has two lateral side walls, each of which is formed with a retaining groove 23 vertically extended therefrom. Meanwhile, each of the recesses 21 has a lower wall formed with an insertion hole 24.

Referring to FIG. 2 again, each of the socket units 30 can be received in one of the recesses 21 and slid upward and downward therein, wherein the socket unit 30 comprises a socket body 31, an upper socket cover 32, a lower socket cover 33 and a pair of conductive terminals 34 inserted in the socket body 31. A lower portion of the socket body 31 is like a cylindrical post, and an upper portion (i.e. a top portion) of the socket body 31 is radially extended outward to form a rectangular guiding slide portion 311. An upper portion of the socket body 31 is recessed inward to form a receiving recess 312, wherein the upper portion of the socket body 31 is formed with an engagement slot 313 on each of two lateral sides of the receiving recess 312. Besides, each of a front side and a rear side of the lower portion of the socket body 31 is formed with an engagement slot 313. A lower portion of the receiving recess 312 of the socket body 31 is formed with two terminal slots 314 passing through the socket body 31. One side (such as a front side) of the guiding slide portion 311 of the socket body 31 is formed with a spherically concave engagement hole 315 recessed inward the socket body 31. In addition, each of two lateral sides of the guiding slide portion 311 is projected to form a slide block 316, wherein each of the slide blocks 316 can be received in one of the retaining recesses 23 and slid upward and downward therein.

The upper socket cover 32 has a central portion formed with two through slots 321 corresponding to the terminal slots 314, while each of two lateral sides of the upper socket cover 32 is projected to form an engagement block 322. The upper socket cover 32 can be engaged in the receiving recess 312, and the engagement blocks 322 can be engaged with the engagement slots 313, so that the upper socket cover 32 can be correspondingly mounted in the receiving recess 312 of the socket body 31.

The conductive terminals 34 are inserted into the terminal slots 314 of the socket body 31, and can be selectively in contact with or disconnected from the conductive frames 50.

The lower socket cover 33 has a central portion formed with two openings 331 corresponding to the terminal slots 314 of the socket body 31, while each of a front side and a rear side of the lower socket cover 33 is projected to form an engagement block 332. The engagement blocks 332 can be engaged with the engagement slots 313, so that the lower socket cover 33 can be correspondingly mounted on the lower portion of the socket body 31.

The two conductive frames 50 is received in the lower housing 10 and disposed under the socket units 30. Each of the conductive frames 50 has a strip-like conductive portion 51, wherein one opposite side edge of each of the two conductive portions 51 is vertically bent and extended to form a plurality of engagement portions 52, each of which has a distal end horizontally extended to form a contact portion 53, as shown in FIG. 2. The contact portion 53 has an upper surface formed with a contact block 54. The conductive portion 51 can be engaged between the partition plates 13, the engagement portions 52 can be engaged into the receiving portions 14, and the contact portions 53 can be supported by the support plates 15.

The separate plate 60 is formed with a plurality of apertures 61 corresponding to the socket units 30 and a plurality of positioning holes 62. The separate plate 60 is disposed above the conductive frames 50, and the positioning holes 62 can be positioned by the positioning posts 16. Meanwhile, the contact portions 53 and the contact blocks 54 are correspondingly extended out of the apertures 61 to be correspondingly in contact with the conductive terminals 34.

Each of the switch units 40 is disposed corresponding to one of the socket units 30, wherein each of the switch units 40 has a bolt handle 41, a bolt rod 42, a bolt-returning spring 43 and a socket-returning spring 44. The bolt handle 41 is designed to be easily pushed and pulled, and formed with a thread hole (not-shown). The bolt rod 42 can be inserted in the bolt hole 22 and slid forward and backward therein, while the bolt rod 42 is aligned with (i.e. corresponding to) the engagement hole 315 of the socket body 31. The bolt rod 42 has an engagement end 421, an installation end 422 and an engagement flange 423 close to the engagement end 421 and radially extended outward therefrom. The engagement end 421 is spherically convex, and the installation end 422 is formed with an outer thread. The bolt-returning spring 43 is sleeved on the bolt rod 42, abutted against a front side of the engagement flange 423 (as shown in the front view of FIG. 2), and disposed between the recess 21 of the upper housing 20 and the socket body 31. The outer thread of the installation end 422 of the bolt rod 42 passes through the bolt hole 22, and then installed in and screw-connected to the thread hole of the bolt handle 41. The socket-returning spring 44 is sleeved on a lower portion of the socket body 31, and disposed between the lower wall of the recess 21 and the separate plate 60 mounted on the lower housing 10. Each of the switch units 40 further has a gasket 45 which can be sleeved on the bolt rod 42, and disposed between the bolt-returning spring 43 and the upper housing 20.

Referring to FIG. 2, when installing the power socket device 1, the conductive frames 50 and the separate plate 60 are firstly installed in the lower housing 10. Then, the bolt-returning spring 43 is sleeved on the front side of the engagement flange 423 of the bolt rod 42. The installation end 422 of the bolt rod 42 passes through the bolt hole 22 of the upper housing 20, and then installed in and screw-connected to the thread hole of the bolt handle 41. Meanwhile, the engagement end 421 of the bolt rod 42 is aligned with the bolt hole 22, and the gasket 45 is sleeved on the bolt rod 42 and disposed between the bolt-returning spring 43 and the upper housing 20. After this, each of the pre-installed socket units 30 is inserted into one of the recesses 21 from the top of the upper housing 20, wherein the guiding slide portion 311 of the socket body 31 is received in one of the recesses 21 and slid upward and downward therein, while each of the slide blocks 316 is correspondingly engaged in one of the retaining recesses 23 and limited to slide upward and downward in the retaining recess 23 for preventing the socket body 31 from separating from the upper housing 20. Furthermore, the lower portion of each of the socket bodies 31 passes through one of the insertion hole 24, and installed and extended in the upper housing 20, wherein the socket-returning spring 44 is sleeved on the lower portion of the socket body 31. Finally, the upper housing 20 is covered on the lower housing 10. After installation, in a case that the socket unit 30 is slid to an upper end of the recess 21 of the upper housing 20, the engagement end 421 is selectively abutted against the guiding slide portion 311 of the socket body 31. On the other hand, in a case that the socket unit 30 is slid to a lower end of the recess 21 of the upper housing 20, the engagement end 421 is selectively engaged in the engagement hole 315.

Referring to FIGS. 2 and 4, when the power socket device 1 having switches of the present invention is used, a plug 2 of an external appliance is firstly plugged in the power socket device 1 having switches of the present invention, the engagement end 421 of the switch unit 421 is originally abutted against the guiding slide portion 311 of the socket body 31, and thus the bolt-returning spring 43 is compressed. Then, a user uses the plug 2 to press downward the socket unit 30, so that the socket unit 30 is slid downward along the retaining groove 23 until the engagement hole 315 of the socket body 31 is lowered downward to be corresponding engaged by the engagement end 421 of the switch unit 40, wherein the socket unit 30 is thus positioned. At this time, the bolt-returning spring 43 is released and returned, while the socket-returning spring 44 is compressed by the socket body 31. As a result, a lower portion of the conductive terminals 34 in the socket body 31 can be in contact with and electrically connected to the contact blocks 54 of the two conductive frames 50.

On the other hand, when it needs to switch off the power of the plug 2, it is unnecessary to unplug the plug 2, wherein the bolt handle 41 can be pulled outward (i.e. forward) to be slid outward by the user, and thus the bolt rod 42 can be shifted outward. At this time, the bolt-returning spring 43 is compressed, so that the engagement end 421 is separated from the engagement hole 315. Once the socket unit 30 is not limited by the bolt rod 42, the socket-returning spring 44 is elastically released and returned to eject the socket unit 30 upward. As a result, the conductive terminals 34 can be separated from and disconnected from the contact blocks 54 of the two conductive frames 50. That is, it is unnecessary to unplug the plug 2 of the external appliance from the power socket device 1 when it needs to switch off the power of the plug 2.

As described above, according to the power socket device 1 having switches of the present invention, a lower portion of each of the socket units 30 is installed with one of the socket-returning springs 44, so that the socket unit 30 can be selectively shifted upward or downward to be electrically connected to or disconnected from the conductive frames 50. A front side of each of the socket units 30 is installed with one of the switch units 40, which can be selectively shifted forward or backward to be elastically released or compressed to abut against the socket unit 30, so that the socket unit 30 can be positioned on a predetermined upper or lower position on a vertical direction. Thus, it is unnecessary to unplug the plug 2 of the external appliance when switching on or off the power. As a result, the operation of the power socket device 1 is relatively simple, while the life time of the external appliance can be elongated.

The present invention has been described with a preferred embodiment thereof and it is understood that many changes and modifications to the described embodiment can be carried out without departing from the scope and the spirit of the invention that is intended to be limited only by the appended claims.

What is claimed is:

1. A power socket device having switches, comprising:

a housing formed with a plurality of recesses on a top portion thereof, and one side wall of the housing being formed with a plurality of bolt holes opened through the recesses, respectively, wherein at least one side wall of each of the recesses is formed with a retaining groove extending vertically, while a lower wall of each of the recesses is formed with an insertion hole opened through the inside of the housing;

a plurality of socket units received in the recesses and partially extending into the insertion holes respectively, each of the socket units comprises a socket body and a pair of conductive terminals installed in the socket body, wherein each of the socket bodies is formed with an engagement hole corresponding to one bolt hole and a slide block slidably disposed in the retaining groove, each of the socket units is enabled to move upward and downward by the slide block;

a plurality of switch units, each of which is corresponding to one of the socket units, wherein each of the switch units comprises a bolt rod passing through one bolt hole and is enabled to move forward and backward; and a pair of conductive frames engaged in the housing and disposed under the socket units, wherein when the socket unit moves to an upper level in the recess, the bolt rod abuts against the socket body, and the conductive terminals are disconnected from the conductive frames; when the socket unit moves to a lower level in the recess, the bolt rod engages into the engagement hole to position the socket body, and the conductive terminals are in contact with the conductive frames.

2. The power socket device according to claim 1, wherein each of the switch units further has a bolt handle disposed outside the housing and covering one of the bolt holes, a bolt-returning spring and a socket-returning spring; the bolt-returning spring is sleeved on the bolt rod and disposed between the side wall of the recess and the socket body, the socket-returning spring is sleeved on a lower portion of the socket body and disposed between the recess and the bottom of the housing, the socket-returning spring is compressed when the socket unit moves to the lower level in the recess; the bolt rod has an installation end and an engagement end, the installation end passes through the bolt hole to be installed in the bolt handle, the engagement end selectively abuts against the socket body or engages into the engagement hole of the socket body, wherein the bolt handle is enabled to be resiliently pulled outward to release the engagement end from the engagement hole and decompress the socket-returning spring.

3. The power socket device according to claim 2, wherein the engagement end is spherically convex, and each of the switch units further has a gasket which is sleeved on the bolt rod and disposed between the bolt-returning spring and the side wall of the recess; and wherein the bolt rod further has an engagement flange close to the engagement end and radially extended therefrom, and the bolt-returning spring abuts against a front side of the engagement flange and is disposed between the side wall of the recess and the socket body.

4. The power socket device according to claim 1, wherein an upper portion of the socket body is formed with a receiving recess; each of the socket body is formed with two terminal slots therein, each of two lateral sides of the receiving recess is formed with an engagement slots, while each of a front side and a rear side of the lower portion of the socket body is also formed with an engagement slot; each of the socket units further has an upper socket cover mounted on the upper portion of the socket body and a lower socket cover mounted on the lower portion of the socket body; the upper socket cover has a central portion formed with two through slots corresponding to the terminal slots; each of two lateral sides of the upper socket cover is projected to form an engagement block; the upper socket cover is engaged in the receiving recess, and the engagement blocks are engaged with the engagement slots on the two lateral sides of the receiving recess; the lower socket cover has a central portion formed with openings corresponding to the terminal slots; each of a front side and a rear side of the lower socket cover is projected to form an engagement block, and the engagement blocks are engaged with the engagement slots on the front side and the rear side of the lower portion of the socket body.

5. The power socket device according to claim 1, wherein the housing comprises an upper housing and a lower housing; the recesses, the bolt holes, the retaining grooves and the insertion holes are formed at the upper housing; the lower housing has a lower plate, and a periphery of the lower plate is projected upward to form an enclosing wall, the lower plate is vertically extended upward to form a plurality of partition plates cooperatively forming a plurality of receiving portions; the lower plate is vertically extended to form a plurality of support plates and a plurality of positioning posts; each of the conductive frames has a strip-like conductive portion, wherein each of two face-to-face side edges of the conductive portions is vertically bent and extended to form a plurality of engagement portions, each of which has a distal end horizontally extended to form a contact portion, wherein the contact portion has an upper surface formed with a contact block; the conductive portion is engaged between the partition plates, the engagement portions are engaged into the receiving portions, and the contact portions are supported by the support plates.

6. The power socket device according to claim 5, further comprising a separate plate which is formed with a plurality of apertures corresponding to the socket units, respectively, and a plurality of positioning holes; the separate plate is disposed above the conductive frames, and the positioning holes are aligned with the positioning posts; the contact portions and the contact blocks of the conductive frames correspondingly extend out of the apertures of the separate plate.

* * * * *